US007866195B2

(12) United States Patent
Levine

(10) Patent No.: US 7,866,195 B2
(45) Date of Patent: Jan. 11, 2011

(54) DOOR LOCK INDICATOR

(76) Inventor: Jonathan E. Levine, 419 Park Ave. South, Suite 505, New York, NY (US) 10016

( * ) Notice: Subject to any disclaimer, the term of this patent is extended or adjusted under 35 U.S.C. 154(b) by 602 days.

(21) Appl. No.: 11/754,027

(22) Filed: May 25, 2007

(65) Prior Publication Data

US 2008/0289383 A1 Nov. 27, 2008

(51) Int. Cl.
*E05B 41/00* (2006.01)

(52) U.S. Cl. ..... 70/432; 70/454; 70/DIG. 30; 70/DIG. 59; 116/80; 200/43.04; 200/43.08; 200/61.64; 200/61.66; 340/542; 362/100

(58) Field of Classification Search ..... 70/432–441, 70/DIG. 59, DIG. 30, DIG. 51, 454; 362/100; 340/5.3, 5.32, 5.6, 5.67, 542, 543, 545.7; 116/80; 200/308, 316, 43.01, 43.04, 43.08, 200/61.62, 61.64, 61.66, 61.67, 61.68
See application file for complete search history.

(56) References Cited

U.S. PATENT DOCUMENTS

| | | | | | |
|---|---|---|---|---|---|
| 3,550,410 | A * | 12/1970 | Toepfer | 70/493 |
| 3,579,183 | A * | 5/1971 | Lipschutz | 340/457 |
| 3,723,677 | A * | 3/1973 | Arias | 200/43.04 |
| 4,490,999 | A | 1/1985 | Castle et al. | |
| 4,559,796 | A | 12/1985 | De Forrest, Sr. | |
| 4,683,741 | A | 8/1987 | Fields | |
| 4,803,467 | A * | 2/1989 | Peters | 340/542 |
| 5,111,007 | A | 5/1992 | Miller et al. | |
| 5,548,984 | A | 8/1996 | Miyatsu | |
| 6,064,316 | A * | 5/2000 | Glick et al. | 340/5.65 |
| 6,255,957 | B1 | 7/2001 | Sonderegger et al. | |
| 6,278,366 | B1 * | 8/2001 | Fletcher et al. | 340/542 |
| 6,354,122 | B1 | 3/2002 | Snoke | |
| 6,622,537 | B2 | 9/2003 | Rodriguez | |
| 6,938,445 | B2 | 9/2005 | Huang | |
| 6,959,568 | B2 | 11/2005 | Abeler | |
| 6,967,562 | B2 * | 11/2005 | Menard et al. | 340/5.64 |
| 6,970,084 | B2 * | 11/2005 | Kwon | 340/542 |
| 7,023,318 | B1 * | 4/2006 | Geiger et al. | 340/5.31 |
| 7,236,085 | B1 * | 6/2007 | Aronson et al. | 340/5.64 |
| 7,334,443 | B2 * | 2/2008 | Meekma et al. | 70/278.7 |
| 7,339,472 | B2 * | 3/2008 | Pierson et al. | 340/542 |
| 7,594,416 | B2 * | 9/2009 | Bosin | 70/432 |
| 2001/0028299 | A1 * | 10/2001 | Blankenship et al. | 340/5.73 |
| 2005/0212653 | A1 * | 9/2005 | Hertel et al. | 340/5.22 |
| 2006/0226948 | A1 * | 10/2006 | Wright et al. | 340/5.25 |
| 2008/0084299 | A1 * | 4/2008 | Fisher et al. | 340/542 |

* cited by examiner

*Primary Examiner*—Lloyd A Gall
(74) *Attorney, Agent, or Firm*—Theodore W. Baker

(57) ABSTRACT

A door lock indicator device is disclosed. The door lock indicator device can include a rotatable portion, a lock status display, and a switch (e.g., a button). The rotatable portion can define an opening shaped to receive a key blade. The door lock indicator device can be installed on a face of a door lock with the opening aligned with a keyhole of the door lock. Rotating a key blade within a keyway of the door lock can cause the rotatable portion to rotate with the door lock's cylinder. The lock status display can include a first indicator light and a second indicator light. Activating the switch can cause the lock status display to indicate a direction of a most recent rotation of the rotatable portion and/or a locked or unlocked status of the associated door lock.

22 Claims, 6 Drawing Sheets

DOOR LOCK INDICATOR

FIELD

This disclosure concerns indicators capable of displaying information to aid in determining whether a door lock is in a locked or unlocked condition.

BACKGROUND

Based on appearance alone, it typically is difficult or impossible to determine whether a conventional door lock is in a locked or unlocked condition. Nevertheless, there can be a regular need to make this determination. For example, because locking doors is a matter of routine that often is performed with little thought or attention, it is relatively common for an individual exiting a door to walk away and then immediately forget whether he or she did or did not lock the door. To verify the status of a conventional door lock, the individual typically must retrieve the appropriate key, insert the key into the door lock, turn the key, and then withdraw the key. This can amount to significant wasted effort. As another example, when approaching a door to gain entry, an individual may wish to know whether he or she can proceed to open the door or whether it will be necessary to first unlock the door, particularly if others have had access to the door since the individual last exited the door. Without knowing whether the door is in a locked or unlocked condition, the individual may waste effort attempting to open the door while it is in a locked condition or attempting to unlock the door while it is in an unlocked condition.

The need to determine whether a door lock is in a locked or unlocked condition can be particularly significant when a door has multiple locks. An individual approaching such a door may find that it does not open even if one of its locks is in an unlocked condition. As a result, the individual may attempt to unlock a door lock that is already in an unlocked condition. This action can actually lock the previously unlocked door lock, resulting in frustration and additional wasted effort.

In view of the scenarios discussed above, there is a need for devices that facilitate determining the status of door locks. Some conventional devices have attempted to address this need. For example, U.S. Pat. No. 4,559,796 (US'796) discloses "a status indicator for a door Sock." US'796 abstract. The status indicator disclosed in US'796 is deficient, in part, because it cannot be installed on an existing door lock without first, disassembling the door lock assembly, US'796, column 4, lines 41-48. As another example, U.S. Pat. No. 6,255,957 (US'957) discloses a system including a key with a display and sensors that interact with markers in a door lock. US'957, abstract. The system disclosed in US'957 is deficient, in part, due to its complexity; its expense, and its inability to account for operation of the door lock with, more than one key.

SUMMARY

Disclosed herein are embodiments of a door lock indicator device. Some disclosed embodiments include a rotatable portion, a lock status display, and a switch (e.g., a button). These elements can be located on a frame shaped for convenient placement on the outside surface of a door lock (e.g., a deadbolt door lock). A fastener configured to affix the door lock indicator device to the outside surface of a door lock also can be included. The rotatable portion can define an opening shaped to receive a key blade. For example, the opening can be an elongated slot with a width between about 1 millimeter and about 3 millimeters and a height between about 8 millimeters and about 20 millimeters. The frame can have a thickness between about 0.5 millimeter and about 5 millimeters in an area within about 5 millimeters of the center of the opening.

Activating the switch can cause the lock status display to indicate a direction of a most recent rotation, of the rotatable portion and/or a locked or unlocked status of an associated door lock. Activating the switch also can cause a light to shine over the opening. Some embodiments of the disclosed door lock indicator device also include a second switch activated by clockwise rotation of the rotatable portion and a third switch activated by counterclockwise rotation of the rotatable portion, in these embodiments, the rotatable portion can include a projection. Clockwise rotation of the rotatable portion can cause the projection to press a contact arm of the second switch into electrical contact with a contact plate of the second switch. Similarly, counterclockwise rotation of the rotatable portion can cause the projection to press a contact arm of the third switch into electrical contact with a contact plate of the third switch. A processor also can be included to change the lock status display based on whether the second switch or the third switch was activated most recently.

In some embodiments of the disclosed door lock indicator device, the lock status display includes a first indicator light and a second indicator light. The first indicator tight can display as an arrow pointing clockwise and the second indicator light can display as an arrow pointing counterclockwise. The first indicator light and the second indicator light each can include a light emitting diode. Activating the switch when the direction of the most recent rotation of the rotatable portion is clockwise can cause the first indicator light to illuminate. Similarly, activating the switch when the direction of the most recent rotation of the rotatable portion is counterclockwise can cause the second indicator light to illuminate. In some disclosed embodiments, activating the switch when the direction of the most recent rotation of the rotatable portion is clockwise causes the first indicator light to illuminate steadily for a period greater than about two seconds and the second indicator light to blink. Similarly, in these embodiments, activating the switch when the direction of the most recent rotation of the rotatable portion is counterclockwise can cause the second indicator light to illuminate steadily for a period greater than about two seconds and the first indicator light to blink.

The switch that causes the lock status display to indicate a direction of a most recent rotation of the rotatable portion and/or a locked or unlocked status of an associated door lock can be referred to a check-status switch. In some disclosed embodiments, the door lock indicator device also includes a lock-orientation switch. The lock-orientation switch can be used to modify the lock status display depending on the type of door lock to which the door lock indicator device is attached (i.e., a clockwise-locking door lock or a counterclockwise-locking door lock). In these embodiments, activating the check-status switch when the lock-orientation switch is in a first position and the direction of the most recent rotation of the rotatable portion is clockwise can cause the first indicator light to illuminate. Similarly, activating the check-status switch when the lock-orientation switch is in a second position and the direction of the most recent rotation of the rotatable portion is clockwise can cause the second indicator tight to illuminate.

A locked marking can be included adjacent to the first indicator light or adjacent to the second indicator light. For example, embodiments of the disclosed door lock indicator device can be part of a kit including a locked marking affixable to the door lock indicator device either adjacent to the first indicator light or adjacent to the second indicator light, in some disclosed embodiments, the locked marking is movable between being adjacent to the first indicator light and being adjacent to the second indicator light.

Also disclosed are embodiments of a method for using a door lock indicator device. These embodiments can include inserting a key blade through an opening of a rotatable portion of a door lock indicator device and into a keyway of a door lock on which the door lock indicator device is attached. The key blade then can be rotated to lock or unlock the door lock while substantially simultaneously rotating the rotatable portion of the door lock indicator device. Embodiments of the disclosed method also can include removing the key blade from the keyway of the door lock and from the opening of the rotatable portion of the door lock indicator device. In addition, embodiments of the disclosed method can include activating a switch to cause a lock status display on the door lock indicator device to indicate a direction of a most recent rotation of the rotatable portion and/or a locked or unlocked status of the door lock. Some embodiments of the disclosed method further include determining a direction of rotation of the key blade in the keyway associated with locking the door lock and affixing a locked marking to the door lock indicator device accordingly. For example, the locked marking can be affixed to the door lock indicator device adjacent to a first indicator light if the direction of rotation of the key blade in the key way associated with locking the door lock is clockwise or adjacent to the second indicator light if the direction of rotation of the key blade in the key way associated with locking the door lock is counterclockwise.

DETAILED DESCRIPTION

Throughout this disclosure, the singular terms "a," "an," and "the" include plural referents unless the context clearly indicates otherwise. Similarly, the word "or" is intended to include "and" unless the context dearly indicates otherwise. Directional terms, such as "upper," "lower," "front," "back," "vertical," and "horizontal," are used herein to express and clarify the relationship between various elements. It should be understood that such terms do not denote absolute orientation (e.g., a "vertical" component can become horizontal by rotating the device).

Disclosed herein are embodiments of a door lock indicator device, embodiments of a door lock indicator device kit, and embodiments of a method for using a door lock indicator device. Some embodiments of the disclosed door lock indicator device can be retrofitted onto an existing door lock without the need to disassemble the door lock. For example, some embodiments can be affixed to an outside surface of a door lock. These embodiments can include a rotatable portion with an opening that can be aligned with a keyhole of the door lock. Thus, when locking or unlocking the door lock, a key blade can pass through the opening of the rotatable portion before entering the keyhole of the door lock. When the key blade is rotated, the rotatable portion of the door lock indicator device can be rotated substantially in unison with the cylinder of the door lock. The direction of the most recent rotation of a key blade in the door lock (as detected via rotation of the rotatable portion) can be recorded in a recallable memory. By correlating the direction of rotation with locking or unlocking the door lock, the door lock indicator device can translate the recorded information into an indicator of the locked or unlocked status of the door lock.

FIGS. 1-10 illustrate one embodiment of the disclosed door lock indicator device. The illustrated device 100 has a substantially round footprint when positioned upright against the face of a door lock. The diameter of the footprint is about 57 millimeters, which is comparable to the diameter of the face cover of a standard deadbolt door lock. Other embodiments can have different shapes and/or sizes. For example, other embodiments can have a footprint that substantially resembles a polygon (e.g., a triangle, a parallelogram, a pentagon, a hexagon, a heptagon, or an octagon). Embodiments of the disclosed door lock indicator device can have footprints larger than, smaller than, or about equal to the surface area of the face cover of a standard deadbolt door lock.

Figure 1:
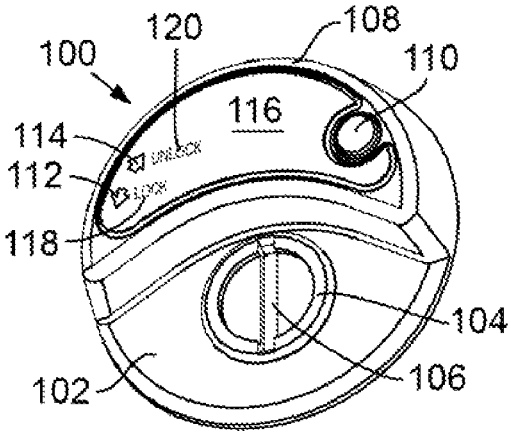
FIG. 1 is a perspective view of the front of one embodiment of the disclosed door lock indicator device including a rotatable portion with a key blade opening.
Figure 2:
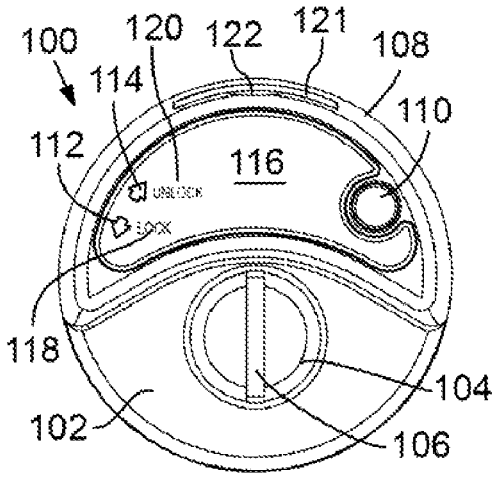
FIG. 2 is a profile view of the front of the embodiment shown in FIG. 1.

As shown, for example, in FIGS. 1 and 2, the illustrated device 100 includes a frame with two portions having different thicknesses. A first portion 102 of the frame is relatively thin and includes a rotatable portion 104 with a centrally positioned key blade opening 106. A second portion 108 of the frame is thicker than the first portion 102 and includes electronics for the device 100. The thinness of the first portion 102, particularly of the rotatable portion 104, minimizes potential interference between the device 100 and a key head. To rotate the cylinder of a door lock, a key blade typically must be fully inserted into the door lock's keyway. If the first portion 102 were too thick, it could either block the key head before the key blade was fully inserted into the keyway of the door lock or block rotation of the key head after the key blade was fully inserted into the keyway of the door lock. In some disclosed embodiments, the first portion 102 has a thickness between about 0.5 millimeter and about 5 millimeters in an area within about 5 millimeters of the center of the key blade opening 106, such as a thickness between about 1 millimeter and about 3 millimeters.

In the illustrated device 100, the key blade opening 106 is rectangular and has a width slightly greater than the width of a standard key blade. For example, the width of the key blade opening 106 can be between about 1 millimeter and about 3 millimeters, such as between about 1.5 millimeters and about 2.5 millimeters. The height of the key blade opening 106 typically is greater than the height of a standard key blade so as to receive a portion of the key head if necessary. For example, the height of the key blade opening 106 can be between about 8 millimeters and about 20 millimeters, such as between about 10 millimeters and about 18 millimeters.

The second portion 108 of the frame includes a button 110, a first indicator light 112, and a second indicator light 114. The first and second indicator lights 112, 114 can indicate a direction of a most recent rotation of the rotatable portion 104 in the first portion 102 of the frame. In a typical installation, the direction of the most recent rotation of the rotatable portion 104 translates into a direction of a most recent rotation of a key blade in a door lock to which the device 100 is attached. In the illustrated device 100, the first and second indicator lights 112, 114 display as arrows pointing counterclockwise and clockwise, respectively. In other embodiments, the first and second indicator lights 112, 114 display as other shapes. For example, the first and second indicator lights can display as substantially round shapes and indicate a direction of the most recent rotation of the rotatable portion 104 by virtue of their relative positions around the perimeter of the frame. In still other embodiments, the first and second indicator lights 112, 114 indicate the locked or unlocked status of an associated door lock without indicating the direction of the most recent rotation of the rotatable portion 104.

In the illustrated device 100, the first and second indicator lights 112, 114 include red light-emitting diodes. In other disclosed embodiments, the first and second indicator lights 112, 114 can include another type of lighting element, such as an incandescent, a fluorescent, a halogen, a xenon, or a neon lighting element. Light-emitting diodes are particularly well suited for use in disclosed embodiments due to their compact size, low power demand, low heat output, long life, and high durability, instead of red light-emitting diodes, other disclosed embodiments can include light-emitting diodes of another color, such as white, orange, yellow, green, or blue.

Different door locks can have different locking and unlocking directions. For example, a deadbolt positioned on the right side of a door (when viewed from the exterior) typically locks by rotation of a key blade in a clockwise direction. In contrast, a deadbolt positioned on the left side of a door (when viewed from the exterior) typically locks by rotation of a key blade in a counterclockwise direction. Some embodiments of the disclosed device are adaptable for use with either type of door lock. The illustrated device 100 includes a label 116 shaped to cover most of the exterior major surface of the second portion 108 of the frame. Below the label 116, the first and second indicator lights 112, 114 are round. Windows in the label 116 cause the first and second indicator lights 112, 114 to be displayed as counterclockwise and clockwise arrows, respectively. These windows can have different shapes in alternative embodiments to achieve the variety of displayed shapes discussed above.

The label 116 includes a "lock" marking 118 adjacent to the first indicator light 112 and an "unlock" marking 120 adjacent to the second indicator light 114. In the illustrated embodiment, die "lock" and "unlock" markings 118, 120 include the words "lock" and "unlock," respectively. In alternative embodiments, the "lock" and "unlock" markings 118, 120 can include images instead of or in addition to the words "lock" and "unlock." For example, the "lock" and "unlock" markings 118, 120 can include images of locked and unlocked padlocks, respectively.

As labeled, die device 100 is compatible with door locks that lock by rotation of a key blade in a counterclockwise direction and unlock by rotation of a key blade in a clockwise direction. For compatibility with door locks that lock and unlock by rotation of a key blade in the opposite directions, embodiments of the device 100 can include a second label 116 with the "lock" marking 118 and the "unlock" marking 120 in the opposite positions. Thus, by placing the appropriate label 116 onto the device 100 depending on the type of door lock onto which the device is to be installed, an end user can accurately position the "lock" and "unlock" markings 118, 120 adjacent to the first and second indicator lights 112, 114. In some disclosed embodiments, windows on the labels 116 above the first and second indicator lights 112, 114 are tinted to change the color of light emitted from the underlying lighting elements. For example, the window adjacent to the "lock" marking 118 can be colored red and the window adjacent to the "unlock" marking 120 can be colored green.

In some disclosed embodiments, the label 116 is relatively small and includes only a "lock" marking or an "unlock" marking. These labels 116 can be associated with the first indicator light 112 or the second indicator light 114, as appropriate, by their placement relative to the overall device 100. Such labels 116 are further described below with reference to FIG. 12. Some disclosed embodiments include a switch that can eliminate the need for selection and/or positioning of the label 116, as described below with reference to FIG. 13.

Figure 6:
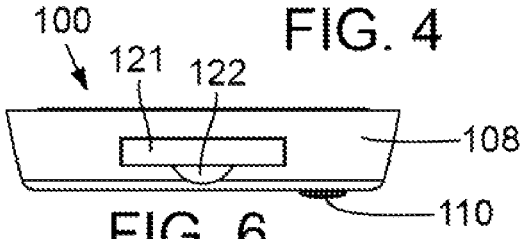
FIG. 6 is a top plan view of the embodiment shown in FIG. 1.
Figure 7:
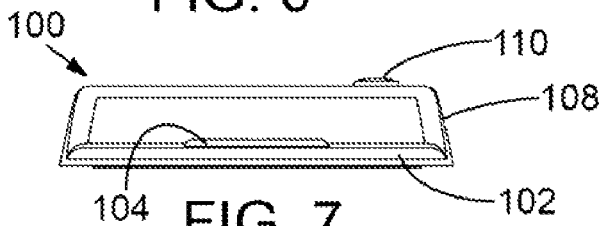
FIG. 7 is a bottom plan view of the embodiment shown in FIG. 1.

FIG. 6 is a top plan, view of the device 100. As shown in FIG. 6, a battery insert 121 projects slightly above the top edge of the second portion 108 of the frame. The battery insert 121 holds a battery, such as a button battery, in the proper position within the device 100. If the battery needs to be replaced, an end user can pull the battery insert 121 upwards out of the second portion 108 of the frame. Once the battery insert 121 has been removed from the second portion 108 of the frame, the battery carried within the battery insert can be replaced, and the battery insert then can be reinserted into the second portion of the frame. A laterally projecting tab 122 is included on the battery insert 121 to facilitate its removal and reinsertion.

Figure 3:
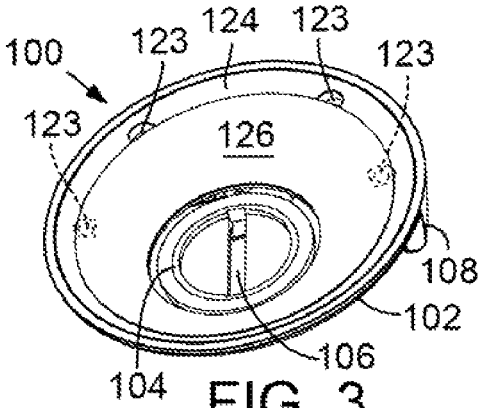
FIG. 3 is a perspective view of the back of the embodiment shown in FIG. 1.
Figure 4:
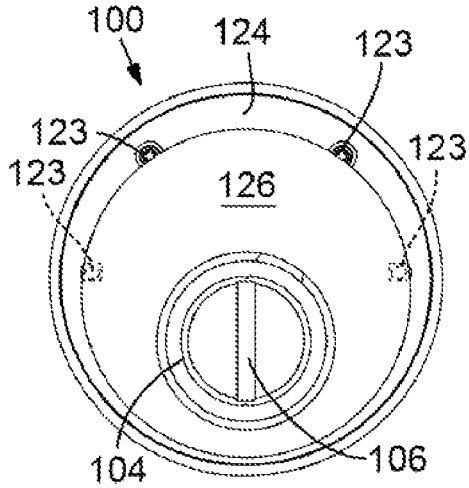
FIG. 4 is a profile view of the back of the embodiment shown in FIG. 1.
Figure 5:
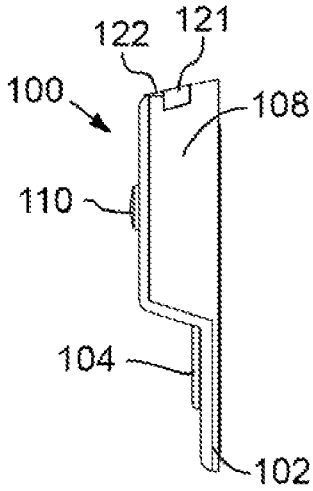
FIG. 5 is a profile view of the side of the embodiment shown in FIG. 1.
Figure 8:
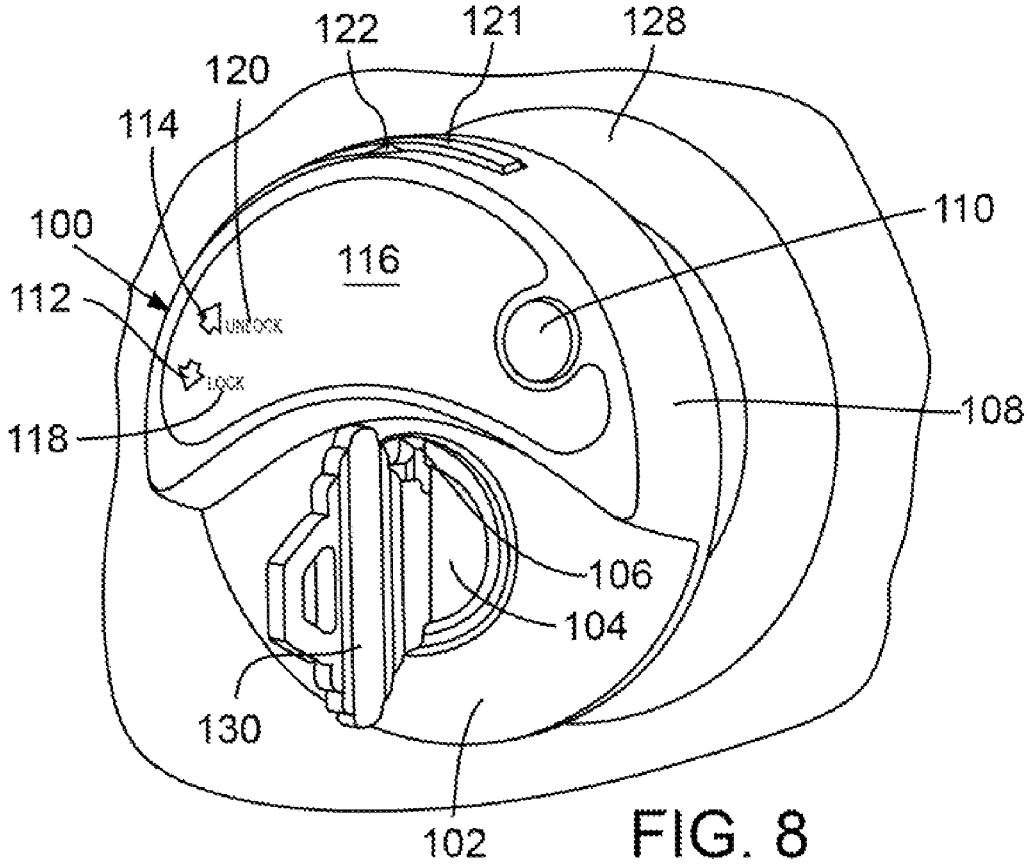
FIG. 8 is a perspective view of the embodiment shown in FIG. 1 attached to the face of a deadbolt door lock and with a key extending though the key blade opening.

FIGS. 3 and 4 are perspective and plan views, respectively, of the back side of the device 100. As shown in FIGS. 3 and 4, four screws 123 attach a back plate 124 to the device 100. An adhesive patch 126 is positioned on the back plate 124 around the rotatable portion 104. The adhesive patch 126 can be used to attach the device 100 to the face of a door lock, such as a standard deadbolt door lock. Other disclosed embodiments can have one or more different fastening elements in place of or in addition to the adhesive patch 126. For example, some disclosed embodiments can be attached to the face of a door lock with hook-and-loop material or magnetic material. FIG. 8 is a perspective view of the device 100 attached to the face of a deadbolt door lock 128. FIG. 8 also shows a key 130 extending through the key blade opening 106 of the device 100.

Figure 9:
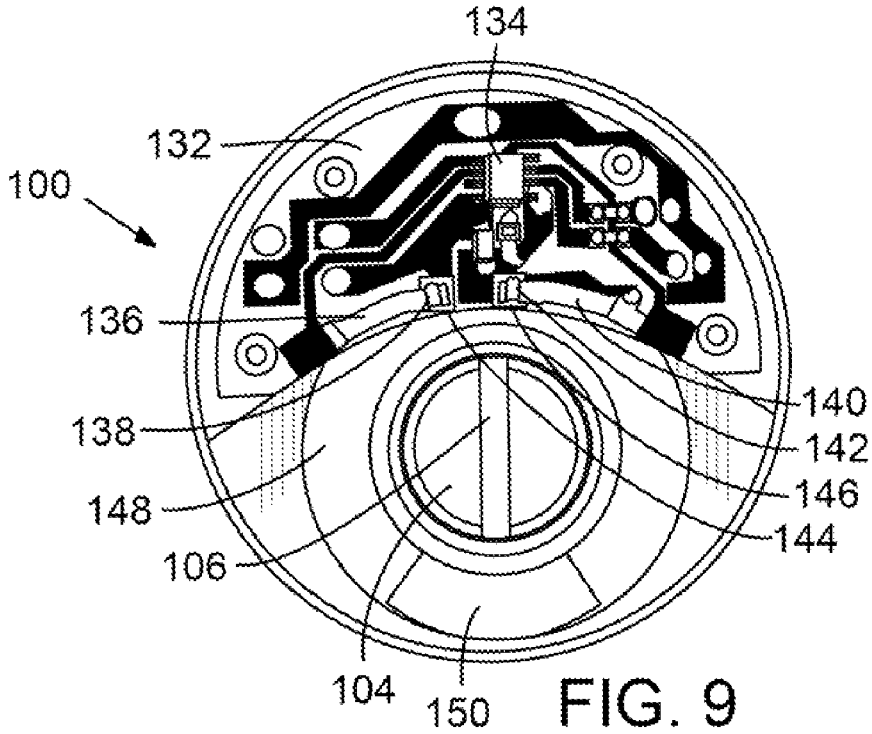
FIG. 9 is a profile view of the back of the embodiment shown in FIG. 1 without its back plate.

FIG. 9 is a plan view of the back side of the device 100 with the screws 123, the back plate 124, and the adhesive patch 126 removed. Within the second portion 108 of the frame, the device 100 includes a circuit board 132 with a processor 134. The circuit board 132 also includes a first contact arm 136 with a first bent portion 138 and a second contact arm 140 with a second bent portion 142. The first and second bent portions 138, 142 are resiliency suspended above first and second contact plates 144, 146, respectively. The first and second contact plates 144, 146 can be flat, round, or another shape. The first portion 102 of the frame includes a recess 148 around the perimeter of the rotatable portion 104. The rotatable portion 104 is attached to a projection 150 that rotates within the recess 148 as the rotatable portion 104 is rotated by a key blade. Thus, clockwise rotation of a key blade within the key blade opening 106 causes clockwise rotation of the rotatable portion 104 and die projection 150. Similarly, counterclockwise rotation of a key blade within the key blade opening 106 causes counterclockwise rotation of the rotatable portion 104 and the projection 150.

In a typical door lock, the door lock's cylinder must be in a certain position (i.e., a starting position) to allow insertion or removal of a key blade from the keyway. Locking or unlocking such a door lock can involve inserting a key blade into the keyway while the cylinder is in the starting position, rotating the key blade (and thus the cylinder) clockwise or counterclockwise until it reaches a clockwise ending position or a counterclockwise ending position, respectively, rotating the key blade back to the starting position, and then withdrawing the key blade. The amount of rotation, from the starting position to the clockwise ending position or from the starting position to the counterclockwise ending position typically is about 135°.

The key blade opening 106 in embodiments of the disclosed door lock indicator device typically remains aligned with the keyhole of an associated door lock during operation of the door lock. In the starting position, the keyhole of a typical door lock is substantially vertical. In its starting position, the key blade opening 106 of the illustrated device 100 also is substantially vertical and the projection 150 is positioned directly below the rotatable portion 104. Rotating a key blade from the starting position to the clockwise ending position causes the projection 150 to contact the second contact arm 140 and press the second bent portion 142 against the second contact plate 146. Similarly, rotating a key blade from the starting position to the counterclockwise ending position causes the projection 150 to contact the first contact arm 136 and press the first bent portion 138 against the first contact plate 144. In this way, interaction between the projection 150 and the first and second contact arms 136, 140 acts as a switch that completes different circuits depending on whether a key blade is rotated clockwise or counterclockwise.

Figure 10:
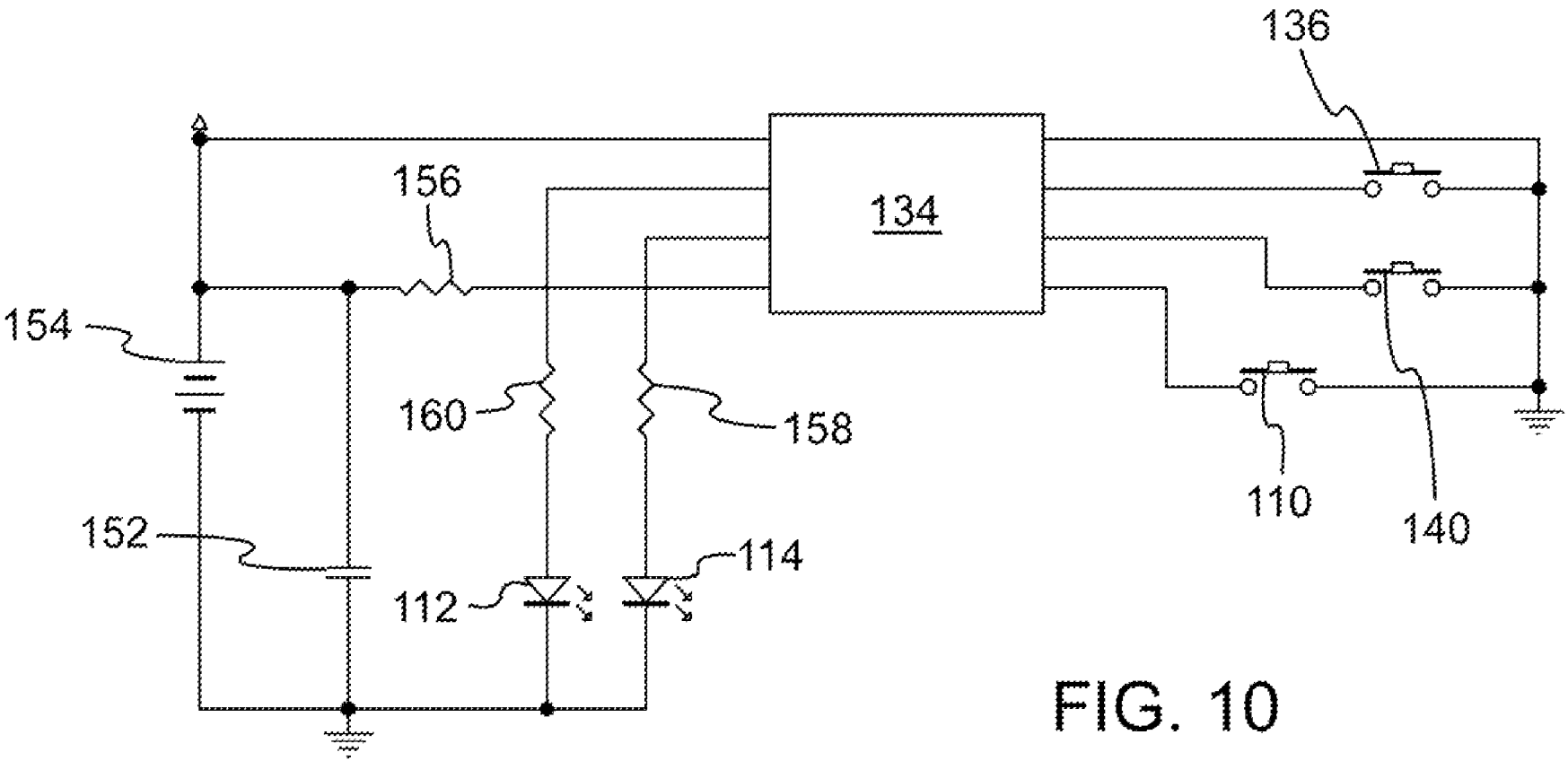
FIG. 10 is a schematic circuit diagram for the embodiment shown in FIG. 1.

FIG. 10 is a schematic circuit diagram for the device 100. The three illustrated switches external to the processor 134 are the button 110, the first contact arm 136, and the second contact arm 140, respectively. The circuit diagram also shows the first indicator light 112, the second indicator light 114, a capacitor 152, a power supply 154, a first resistor 156, a second resistor 158, and a third resistor 160. The power supply 154 typically is a battery, as discussed above. The processor 134 can be configured to activate the first and second indicator lights 112, 114 in response to operation of each of the switches. In the illustrated device 100, activation of the switch including the first contact arm 136 triggers a first display sequence in which the first indicator light 112 illuminates steadily for a period greater than about two seconds and, subsequently, the second indicator light 114 blinks. Similarly, activation of the switch including the second contact arm 140 triggers a second display sequence in which the second indicator light 114 illuminates steadily for a period greater than about two seconds and, subsequently, the first indicator light 112 blinks. Pressing the button 110 triggers the first display sequence if the switch including the first contact arm 136 was activated most recently or the second display sequence if the switch including the second contact arm 140 was activated most recently.

Steady illumination of the first or second indicator light 112, 114 can indicate that a door lock to which the device 100 is attached is in a locked or unlocked condition. For example, if counterclockwise rotation of a key blade in an associated door lock causes the door lock to become locked, steady illumination of the first indicator light 112 can indicate that the door lock is in a locked, condition and steady illumination of the second indicator light 114 can indicate that the door lock is in an unlocked condition. Blinking illumination of the first or second indicator light 112, 114 can indicate a direction in which a key blade must be turned to change the locked or unlocked status of an associated door lock. Alternatively, in some embodiments, there is no indication of a direction, in which a key blade must be turned to change the locked or unlocked status of an associated door lock.

The indication of the locked or unlocked status of an associated door lock and/or the direction in which a key blade must be turned to change the locked or unlocked status of an associated door lock can vary in different embodiments of the disclosed device. For example, in some disclosed embodiments, blinking illumination of the first or second indicator light 112, 114 can indicate that an associated door lock currently is in the condition associated with the blinking indicator light. The first and second indicator lights 112, 114 also can display different colors to indicate the locked or unlocked status of an associated door lock and/or the direction in which a key blade must be turned to change the locked or unlocked status of an associated door lock. For example, the first and second indicator lights 112, 114 each can include a dual-color or tri-color light-emitting diode or two or more light-emitting diodes having different colors. In some disclosed embodiments, the first and second indicator lights 112, 114 are replaced with a single indicator light that displays different colors to indicate the locked or unlocked status of an associated door lock. The colors green and red can be used to indicate that an associated door lock is in an unlocked or locked condition, respectively. Embodiments of the disclosed door lock indicator device also can indicate the locked or unlocked status of an associated door lock and/or the direction in which a key blade must be turned to change the locked or unlocked status of an associated door lock with audio signals instead of or in addition to visual signals. These audio signals can include, for example, recorded voice statements, electronically generated voice statements, differentiated beeping, or differentiated tones.

In alternate embodiments, the button 110 can have different forms. For example, the button 110 can be replaced with another type of switch, such as a toggle switch. The button 110 also can be replaced with a switch including a commercially available motion detector. In some disclosed embodiments, counterclockwise or clockwise rotation of a key blade within the key blade opening 106 causes the first indicator light 112 or the second indicator light 114 (or a single indicator light in place of the first and second indicator lights 112, 114) to remain illuminated until the locked or unlocked status of the associated door lock is reversed. These embodiments, for example, can include no button 110 to perform a status cheek because the locked or unlocked status of the associated door lock is permanently displayed.

Figure 11:
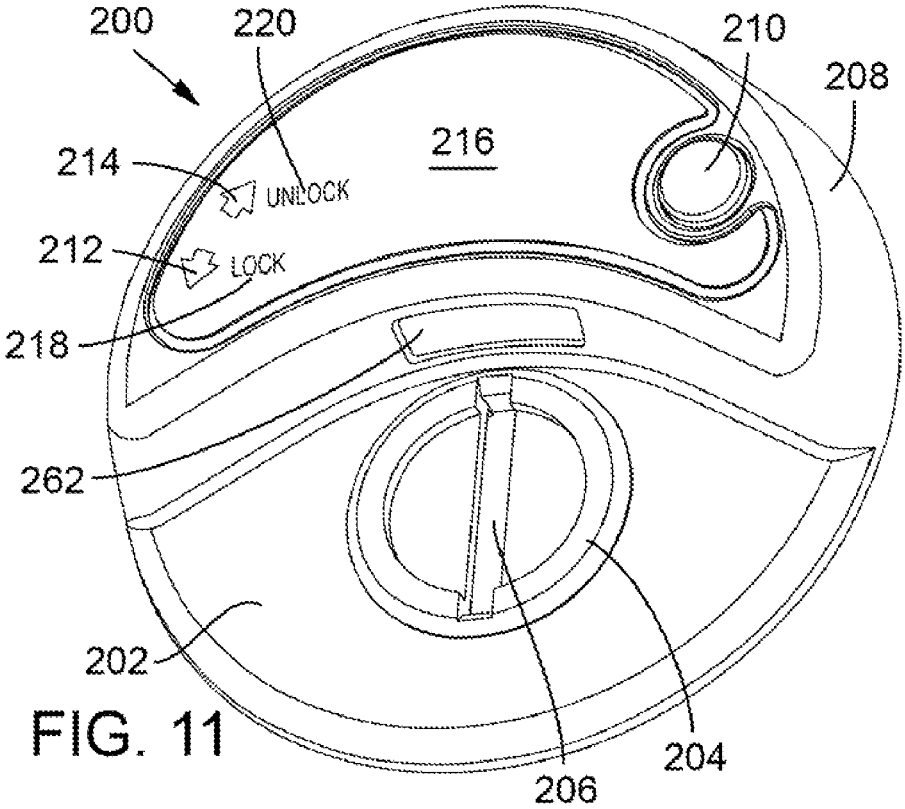
FIG. 11 is a perspective view of the front of a second embodiment of the disclosed door lock indicator device including a keyhole light.

FIG. 11 is a perspective view of the front side of a second embodiment of the disclosed door lock indicator device. The first digit of each reference number shown in FIG. 11 is "2." The second two digits of the reference numbers shown in FIG. 11 are identical to the second two digits of the reference numbers shown in FIGS. 1-10 for similar or identical elements. The illustrated device 200 is similar to the device 100 shown in FIGS. 1-10, but also include a keyhole light 262. The keyhole light 262 assists end users with the process of inserting a key blade in the keyhole of a door lock to which the device 200 is attached when there is insufficient light. Like the first indicator light 212 and the second indicator light 214, the keyhole light 262 can include a lighting element that shines through a window. The lighting element can be a light-emitting diode or another type of lighting element, such as an incandescent, a fluorescent, a halogen, a xenon, or a neon lighting element. In the illustrated device 200, the keyhole light 262 includes a white light-emitting diode. The keyhole light 262 can be permanently illuminated or can be illuminated in response to a signal from an end user, such as a signal triggered by pressing the button 210 or a signal from a commercially available motion detector on the device 200.

Figure 12:
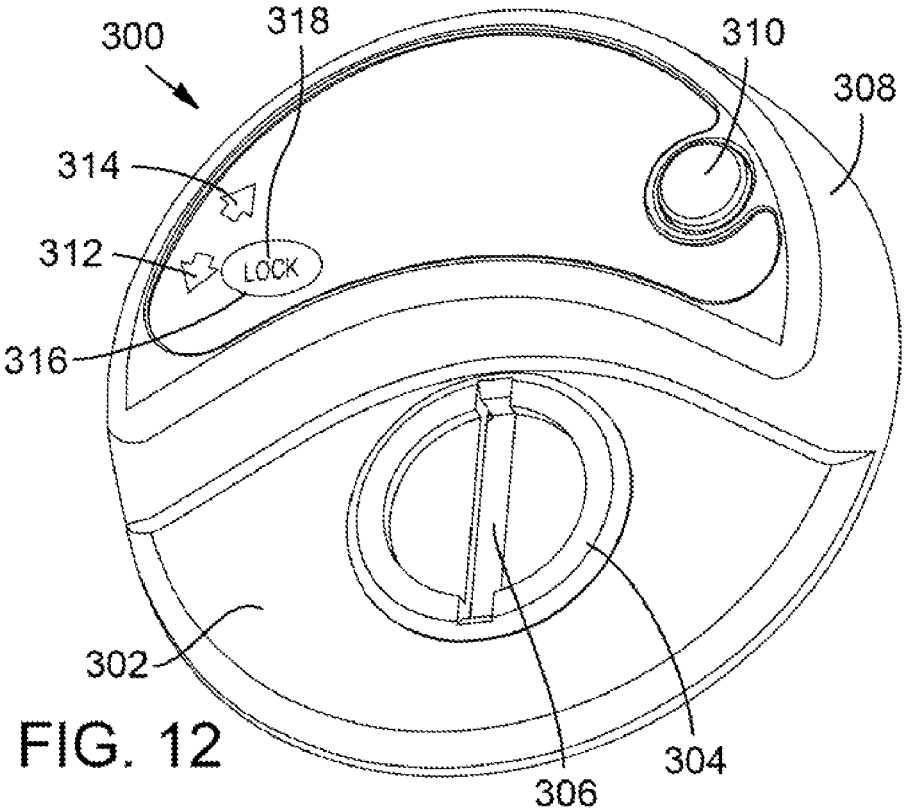
FIG. 12 is a perspective view of the front of a third embodiment of the disclosed door lock indicator device including a selectively positionable "lock" label.

FIG. 12 is a perspective view of the front side of a third embodiment of the disclosed door lock indicator device. The first digit of each reference number shown in FIG. 12 is "3." The second two digits of the reference numbers shown in FIG. 12 are identical to the second two digits of the reference numbers shown in FIGS. 1-10 for similar or identical elements. The illustrated device 300 is similar to the device 100 shown in FIGS. 1-10, except that the label 316 is relatively small and includes only a "lock" marking 318. The label 316 can be placed adjacent to the first indicator light 312 or the second indicator light 314 depending on the locking direction of an associated door lock.

Figure 13:
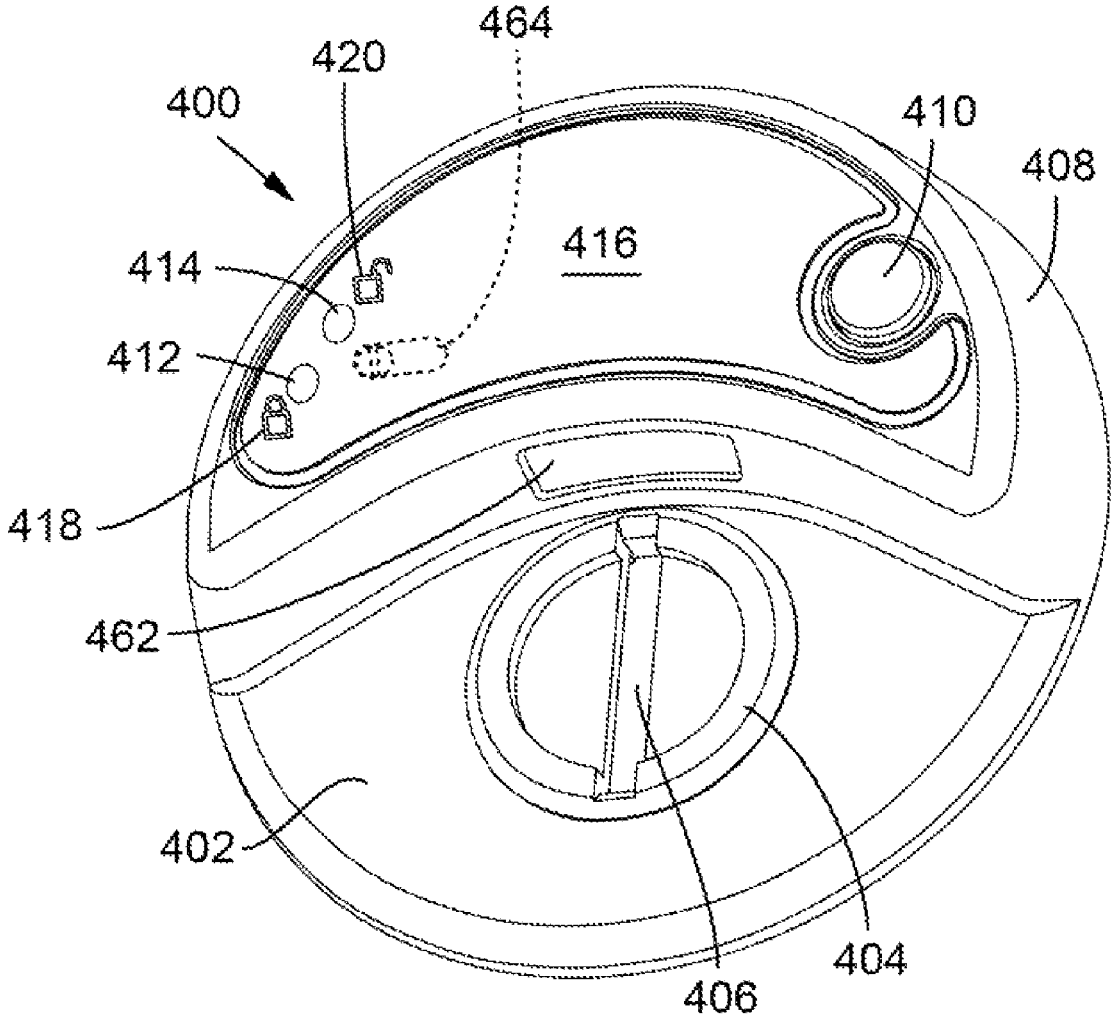
FIG. 13 is a perspective view of the front of a fourth embodiment of the disclosed door lock indicator device including a keyhole light and a lock-orientation switch.
Figure 14:
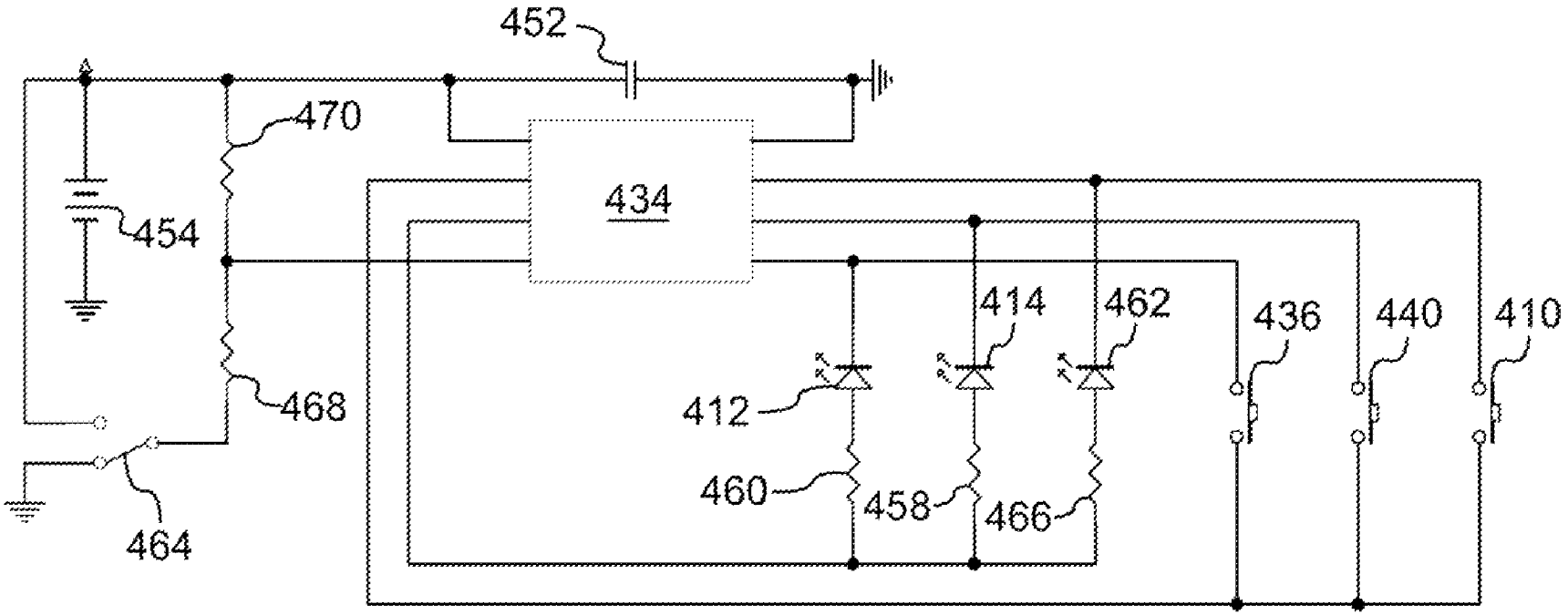
FIG. 14 is a schematic circuit diagram for the embodiment shown in FIG. 13.

FIG. 13 is a perspective view of the front side of a fourth embodiment of the disclosed door lock indicator device. The first digit of each reference number shown in FIG. 13 is "4." The second two digits of tire reference numbers shown in FIG. 13 are identical to the second two digits of the reference numbers shown in FIGS. 1-10 for similar or identical elements. The illustrated device 400 is similar to the device 100 shown in FIGS. 1-10, but also includes a keyhole light 462 and a lock-orientation switch 464 positioned on the second portion 408 of the frame. The "lock" and "unlock" markings 418, 420 are images of locked and unlocked padlocks, respectively. In addition, the first indicator light 412 and the second indicator light 414 display as round shapes rather than arrows. In FIG. 13, the lock-orientation switch 464 is in a first position. From the first position, the lock-orientation switch 464 can be shifted to the right into a second, position. As shown, in FIG. 13, the lock-orientation switch 464 is flush, with the surface of the second portion 408 of the frame and covered by the label 416. FIG. 14 is a schematic circuit diagram for the device 400. In addition to the components described above with reference to FIG. 10, the schematic circuit diagram shown in FIG. 14 includes a keyhole light resistor 466, a first voltage signal resistor 468, and a second voltage signal resistor 470.

Changing the position of the lock-orientation switch 464 can change the manner in which the first indicator light 412 and the second indicator light 414 illuminate in response to clockwise and counterclockwise rotation of the rotatable portion 404. In this way, the device 400 can be conveniently adapted for use with door locks that lock by rotation of a key blade in either a clockwise or a counterclockwise direction. For example, when the lock-orientation switch 464 is in the first position, clockwise rotation of the rotatable portion 404 can cause steady illumination of the first indicator light 412 and counterclockwise rotation of the rotatable portion 404 can cause steady illumination of the second indicator light 414. Thus, when the lock-orientation switch 464 is in the first position, the device 400 can be adapted for use with a door lock that locks by rotation of a key blade in a clockwise direction. When the lock-orientation switch 464 is in the second position, counterclockwise rotation of the rotatable portion 404 can cause steady illumination of the first indicator light 412 and clockwise rotation of the rotatable portion 404 can cause steady illumination of the second indicator light 414. Thus, when the lock-orientation switch 464 is in the second position, the device 400 can be adapted for use with a door lock that locks by rotation of a key blade in a counterclockwise direction. An end user can set the lock-orientation switch 464 according to the type of door lock, on which the device 400 is to be installed. Since the lock-orientation switch 464 only needs to be set once per installation, the label 416 can be positioned over the lock-orientation switch 464 after the lock-orientation switch is set.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. I therefore claim as my invention all that comes within the scope and spirit of these claims.

I claim:

1. A door lock indicator device, comprising:

a frame including a rotatable portion defining an opening shaped to receive a key blade;

a lock status display; and a check-status switch, wherein the door lock indicator device is battery powered, the door lock indicator device is configured to be attached to an existing door lock with the opening aligned with a keyhole of the door lock such that a key extending through the opening and into the keyhole of the door lock is capable of operating the door lock, activating the check-status switch is independent of rotation of the rotatable portion, and activating the check-status switch when the door lock indicator device is attached to the door lock causes the lock status display to indicate a direction of a most recent rotation of the rotatable portion, a locked or unlocked status of the door lock, or both the direction of the most recent rotation of the rotatable portion and the locked or unlocked status of the door lock.

2. The door lock indicator device according to claim 1, wherein the opening is an elongated slot with a width between about 1 millimeter and about 3 millimeters and a height between about 8 millimeters and about 20 millimeters.

3. The door lock indicator device according to claim 1, wherein activating the check-status switch also causes a light to shine over the opening.

4. The door lock indicator device according to claim 1, further comprising a fastener configured to affix the door lock indicator device to the door lock.

5. The door lock indicator device according to claim 1, wherein the check-status switch includes a button.

6. The door lock indicator device according to claim 1, wherein the frame has a thickness between about 0.5 millimeter and about 5 millimeters in an area within about 5 millimeters of a center of the opening.

7. The door lock indicator device according to claim 1, further comprising:

a clockwise-rotation switch activated by clockwise rotation of the rotatable portion; and a counterclockwise-rotation switch activated by counterclockwise rotation of the rotatable portion.

8. The door lock indicator device according to claim 7, wherein the rotatable portion includes a projection, the clockwise-rotation switch includes a contact arm and a contact plate, the counterclockwise-rotation switch includes a contact arm and a contact plate, clockwise rotation of the rotatable portion causes the projection to press the contact arm of the clockwise-rotation switch into electrical contact with the contact plate of the clockwise-rotation switch, and counterclockwise rotation of the rotatable portion causes the projection to press the contact arm of the counterclockwise-rotation switch into electrical contact with the contact plate of the counterclockwise-rotation switch.

9. The door lock indicator device according to claim 7, further comprising a processor configured to change the lock status display based on whether the clockwise-rotation switch or the counterclockwise-rotation switch was activated most recently.

10. The door lock indicator device according to claim 1, wherein the lock status display includes a first indicator light and a second indicator light.

11. The door lock indicator device according to claim 10, wherein the first indicator light displays as an arrow pointing clockwise and the second indicator light displays as an arrow pointing counterclockwise.

12. The door lock indicator device according to claim 10, wherein the first indicator light and the second indicator light each include a light emitting diode.

13. The door lock indicator device according to claim 10, wherein activating the check-status switch when the direction of the most recent rotation of the rotatable portion is clockwise causes the first indicator light to illuminate, and activating the check-status switch when the direction of the most recent rotation of the rotatable portion is counterclockwise causes the second indicator light to illuminate.

14. The door lock indicator device according to claim 10, wherein activating the check-status switch when the direction of the most recent rotation of the rotatable portion is clockwise causes the first indicator light to illuminate steadily for a period greater than about two seconds and the second indicator light to blink, and activating the check-status switch when the direction of the most recent rotation of the rotatable portion is counterclockwise causes the second indicator light to illuminate steadily for a period greater than about two seconds and the first indicator light to blink.

15. The door lock indicator device according to claim 10, wherein the door lock indicator device further comprises a lock-orientation switch, activating the check-status switch when the lock-orientation switch is in a first position and the direction of the most recent rotation of the rotatable portion is clockwise causes the first indicator light to illuminate, and activating the check-status switch when the lock-orientation switch is in a second position and the direction of the most recent rotation of the rotatable portion is clockwise causes the second indicator light to illuminate.

16. The door lock indicator device according to claim 10, further comprising a locked marking adjacent to the first indicator light or the second indicator light.

17. The door lock indicator device according to claim 16, wherein the locked marking is movable between being adjacent to the first indicator light and being adjacent to the second indicator light.

18. A door lock indicator device kit, comprising:

a door lock indicator device having a rotatable portion defining an opening shaped to receive a key blade, a lock status display, and a check-status switch, wherein the lock status display includes a first indicator light and a second indicator light, independently activating the check-status switch when a direction of a most recent rotation of the rotatable portion is clockwise causes the first indicator light to illuminate, and independently activating the check-status switch when the direction of the most recent rotation of the rotatable portion is counterclockwise causes the second indicator light to illuminate; and a locked marking separate from the door lock indicator device and affixable to the door lock indicator device either adjacent to the first indicator light or adjacent to the second indicator light.

19. The door lock indicator device kit according to claim 18, further comprising a fastener configured to affix the door lock indicator device to an existing door lock.

20. A method for using a door lock indicator device, comprising:

inserting a key blade through an opening of a rotatable portion of a door lock indicator device and into a keyway of a door lock to which the door lock indicator device is attached;

rotating the key blade to lock or unlock the door lock, wherein rotating the key blade rotates the rotatable portion of the door lock indicator device;

removing the key blade from the keyway of the door lock and the opening of the rotatable portion of the door lock indicator device; and activating a check-status switch after removing the key blade from the keyway to cause a lock status display on the door lock indicator device to indicate a direction of a most recent rotation of the rotatable portion, a locked or unlocked status of the door lock, or both the direction of the most recent rotation of the rotatable portion and the locked or unlocked status of the door lock.

21. The method according to claim 20, further comprising attaching the door lock indicator device to the door lock.

22. The method according to claim 20, wherein the lock status display includes a first indicator light and a second indicator light, activating the check-status switch when the direction of the most recent rotation of the rotatable portion is clockwise causes the first indicator light to illuminate, activating the check-status switch when the direction of the most recent rotation of the rotatable portion is counterclockwise causes the second indicator light to illuminate, and the method further comprises attaching a locked marking to the door lock indicator device adjacent to the first indicator light if the direction of rotation of the key blade in the keyway associated with locking the door lock is clockwise or adjacent to the second indicator light if the direction of rotation of the key blade in the keyway associated with locking the door lock is counterclockwise.

* * * * *